United States Patent [19]

Keith et al.

[11] 4,319,591

[45] Mar. 16, 1982

[54] SMOKING COMPOSITIONS

[75] Inventors: Charles H. Keith; Bruce D. Karstedt, both of Charlotte, N.C.

[73] Assignee: Celanese Corporation, New York, N.Y.

[21] Appl. No.: 871,673

[22] Filed: Jan. 23, 1978

Related U.S. Application Data

[63] Continuation of Ser. No. 543,750, Jan. 24, 1975, abandoned, which is a continuation of Ser. No. 224,996, Feb. 9, 1972, abandoned.

[51] Int. Cl.[3] ..... A24B 15/30; A24B 1/18

[52] U.S. Cl. ..... 131/359; 131/276

[58] Field of Search ..... 131/2, 15, 17, 140 R, 131/140 C; 131/354, 359, 276, 369

[56] References Cited

U.S. PATENT DOCUMENTS

| | | | |
|---|---|---|---|
| 3,545,448 | 12/1970 | Mormon | 131/2 |
| 3,818,915 | 6/1974 | Anderson | 131/2 |
| 3,875,948 | 4/1975 | Monte | 131/2 |
| 3,931,824 | 1/1976 | Miano et al. | 131/2 |

FOREIGN PATENT DOCUMENTS

| | | | |
|---|---|---|---|
| 2114083 | 11/1971 | Fed. Rep. of Germany | 131/359 |
| 10040 | 3/1972 | Japan . | |
| 7103800 | 9/1971 | Netherlands | 131/359 |
| 7103863 | 9/1971 | Netherlands | 131/359 |
| 7103865 | 9/1971 | Netherlands | 131/359 |
| 7103866 | 9/1971 | Netherlands | 131/359 |
| 7110555 | 2/1972 | Netherlands | 131/359 |
| 7315988 | 6/1974 | Netherlands | 131/359 |

OTHER PUBLICATIONS

*Tobacco Flavoring for Smoking Products* by Leffingweil et al., Publishedby R. J. Reynolds Tobacco Co., 1972, Winston Salem, North Carolina, U.S., p. 63.

*Dangerous Prop. of Industrial Mat's* by Jax, 3rd edit., 1969, p. 461.

*Tobacco and Tobacco Smoke* by Wynder et al., 1967, p. 350.

*The Chemistry and Technology of Tob.*, by Schmuh, pp. 602 & 603 et al., vol. IV, 1953, Published by Pishchep.

*Primary Examiner*—V. Millin

*Attorney, Agent, or Firm*—Robert J. Blanke

[57] ABSTRACT

Smoking compositions having improved taste and odor are prepared by incorporation into the composition of minor amounts of proteins and protein hydrolysates, at least 80% of the weight of which is derived from aliphatic and heterocyclic amino acids.

10 Claims, No Drawings

SMOKING COMPOSITIONS

This is a continuation of application Ser. No. 543,750, filed Jan. 24, 1975, now abandoned, which is a continuation of Ser. No. 224,996, filed Feb. 9, 1972, now abandoned.

A number of compositions have been described in the prior art as being suitable replacements for leaf tobacco in smoking products such as cigarettes, cigars, pipe tobacco, etc. A material presently finding wide commercial acceptance is "dry process" reconstituted tobacco, a film of tobacco dust held together by a minor amount, e.g. 5% of a suitable binder. Other described replacements are essentially of a synthetic nature, although minor amounts of tobacco, e.g. up to 30 or 40%, may be incorporated to produce a more tobacco-like flavor and appearance.

Generally, these synthetic replacements are comprised of a combustible substrate having incorporated therein combustion modifiers, ordinarily inorganic compounds, which cause the combustible substrate to burn at a rate similar to that of tobacco leaf. Combustible substrates taught in the prior art include, for example, alpha-cellulose or oxidized cellulose (U.S. Pat. No. 3,461,879, issued Aug. 19, 1969), thermally degraded cellulose (Canadian Pat. No. 822,969, issued Sept. 16, 1969), the pectins and alginates (U.S. Pat. No. 3,529,602, issued Sept. 22, 1970), and naturally occurring plant gums and resins, such as guar gum, locust bean gum, gum tragacanth, gum arabic and carrageen.

British Pat. No. 1,244,441, published Sept. 2, 1971, describes particularly desirable tobacco replacements having combustible substrates selected from the group consisting of starch, and starch and cellulose derivatives including salts thereof containing the recurring anhydroglucose unit

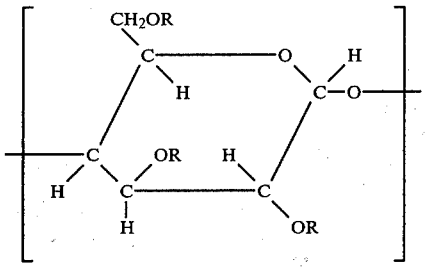

wherein at least one R is selected from the group consisting of lower alkyl, hydroxy lower alkyl, carboxy lower alkyl groups, and mixtures thereof, and the remaining R's are hydrogen atoms. Preferably, R is selected from the group consisting of $CH_2COOM$, $CH_2CH_2OH$ and $CH_3$; in which M is a nontoxic cation or hydrogen, and preferably is selected from the group consisting of alkali metal and alkaline earth metals, aluminum, iron, and hydrogen. Compounds of the above nature ordinarily have an average degree of substitution for hydrogens of from about 0.2 to about 3.0 R groups per unit, and preferably, have from about 0.4 to about 1.2 groups per unit. Mixtures of these compounds are also described as being suitable.

Combustible substrates described as being paticularly desirable are carboxymethyl cellulose, carboxyethyl cellulose, hydroxyethyl cellulose, carboxymethyl hydroxyethyl cellulose, methyl cellulose, carboxymethylated starch, analogous compounds such as ethyl cellulose, hydroxypropyl cellulose, carboxyethyl starch, and salts thereof.

Smoking compositions may also be prepared using mixtures of any of the foregoing tobacco replacements.

Numerous combustion modifiers have been described as being suitable for modification of the burning rates of these prior art combustible substrates. Generally, the preferred combustion modifiers are inorganic compounds of a non-toxic nature, i.e., pharmacologically inactive in the sense of significant adverse effects in a causative relationship upon oral ingestion of the substance itself or its combustion products. Suitable combustion modifiers can also be selected from the organic compounds and the elements.

Normally, the ratio of combustible substrate to combustion modifier (the term being used interchangeably with the term filler) should be from about 15:85 to 85:15, and preferably from about 25:75 to 75:25.

Prior art combustion modifiers also suitable for use in the present compositions, and which may also serve to varying degrees as fillers which reduce the total amount of combustible substance present, and thus the total amount of combustion products, are non-toxic particulate materials, preferably having an average minimum dimension of from about 0.2 microns to about 1.0 millimeter. It is also preferred that the particulate materials have a maximum dimension of about 0.25 mm, and more preferably, about 0.10 mm.

Inorganic compounds which may be used as combustion modifiers and/or fillers may be comprised of a cation selected from Column (A) and an anion selected from Column (B).

| (A) | | | (B) |
|---|---|---|---|
| Lithium | Manganese | Silicon | Oxides |
| Sodium | Aluminum | Palladium | Hydrated Oxides |
| Potassium | Cerium | Tin | Hydroxides |
| Cesium | Cobalt | Zinc | Carbonates |
| Magnesium | Iron | Titanium | Phosphates |
| Calcium | Molybdenum | Zirconium | Aluminates |
| Strontium | Nickel | Copper | Stannates |
| Barium | Rubidium | | Zincates |
| | | | Silicates |
| | | | Carbides |

Preferably, the cations employed are selected from the group consisting of zinc, titanium magnesium, calcium, aluminum and iron. Desirably, these cations are in the form of the carbonates, oxides, hydroxides, sulfates, phosphates, aluminates, silicates and alumino silicates. The oxides, carbonates and hydroxides are particularly desirable since these anions decompose to carbon, hydrogen and oxygen upon combustion. Inorganic compounds in their natural occurring states, such as limestone (particularly dolomite), diatomaceous earth, perlite, magnesite, vermiculite, etc. are also suitable.

As previously noted, elements may also be used as filler materials. Preferred elements include carbon, zinc, magnesium, titanium, aluminum, and iron.

While the filler materials are generally granular in nature, they may also be in fibrous form. Materials readily useable in fibrous form are fiberglass, mica, asbestos, metal metal oxide, and metal carbide whiskers. For the purposes of the present invention, thin metal strips such as aluminum shaving are considered to be fibrous. Preferably, the fibrous materials will have an average length of from about 1.0 mm to about 5 mm., and an average minimum dimension of the magnitude previously noted.

It is also possible, and often desirable, to employ combinations of particulate fillers in order to obtain the ultimate smouldering rate desired. Fillers found to be particularly suitable in controlling smouldering rates include titanium dioxide, carbon, magnesium oxide, zeolite, silica gel, magnesium silicate, and diatomaceous earth.

The foregoing smoking compositions, a term used herein to generically encompass dry process reconstituted tobacco and tobacco replacements for the sake of brevity, while exhibiting varying degrees of utility, have also been found to have certain deficiencies. Of primary significance, is the fact that these materials, when used to replace tobacco entirely or in significant percentages in smoking products, tend to yield a smoke that has a taste and odor which may be somewhat irritating to the smoker. The utility of these compositions would be greatly enhanced if this deficiency could be diminshed.

Accordingly, it is an object of the present invention to provide smoking compositions which, upon combustion, yield a smoke which is less irritating to the smoker. Other objects of the present invention, if not specifically set forth herein, will be obvious to the skilled artisan upon a reading of the present specification.

Surprisingly, it has been found that the taste and odor properties of the foregoing smoking compositions can be significantly improved by the incorporation therein of a minor amount, i.e., from about 0.1 to about 5.0, and preferably from about 1.0 to about 2.5 percent by weight of the smoking composition of a protein or protein hydrolysate, at least 80 percent of the weight of which is derived from aliphatic amino acids and heterocyclic amino acids. Preferably, less than 10 percent by weight of the protein or protein hydrolysate is derived from sulfur-containing amino acids.

The term "aliphatic amino acids" is intended to encompass the monoaminocarboxylic acids: glycine, alanine, valine, leucine, isoleucin, serine and threonine; the monoaminodicarboxylic acids: aspartic acid, asparagine, glutamic acid and glutamine; and the basic amino acids: lysine, hydroxylysine, arginine and histidine. The term "heterocyclic amino acids" is intended to encompass tryptophan, proline and hydroxyproline.

Suitable proteins include, for example, egg albumen, gelatine, collagen, soybean protein, casein, zein and gliadin.

The foregoing proteins are normally incorporated into the smoking compositions by intimately mixing them with the other ingredients of the smoking composition either before or after the addition of water and then casting a film therefrom in aqueous state. Preferably, the material at the time of casting is comprised of 65 to 95 percent water. The cast film preferably has a dried thickness of from about 5 to about 15 mils.

The following example is presented as illustrative of the present invention and should not be construed as being in limitation thereof.

EXAMPLE

The following ingredients were intimately mixed together in water to form a dough:

| Ingredient | Parts by Wt. |
|---|---|
| Sodium Carboxymethyl Cellulose | 11.0 |

-continued

| Ingredient | Parts by Wt. |
|---|---|
| Dolomite | 16.0 |
| Diatomaceous Earth | 12.0 |
| Glycerine | 0.6 |
| Carbon | 0.25 |
| Coloring Agents | 0.22 |
| Flavorants | 0.7 |
| Collagen | 0.8 |

This dough was cast into a film and dried, after which the film was shredded and made into cigarettes 85 mm in length, 8 mm in diameter and weighing 1.2 grams. The smoke from these cigarettes were mild and noticeably less irritating than the smoke from cigarettes made from an otherwise identical tobacco substitute from which the collagen had been omitted.

Cigarettes thus prepared were also smoked to a 30 mm butt length on an apparatus which took 35 ml. puffs over a 2-second interval on a 60-second cycle. Tar was collected by drawing the smoke through a Cambridge filter pad which removed at least 98% of the solid particulate matter and weighing the pad before and after smoking. Cigarettes prepared from the above tobacco substitute delivered only 4.7 grams of tar per cigarette as compared to a delivery of 28.0 from an all-tobacco cigarette of the same weight.

A determination was also made of the gas phase constituents of the cigarettes. These results, as compared to an all-tobacco cigarette of equal weight is as follows:

| Constituent | Tobacco Substitute Cigarette | All-Tobacco Cigarette |
|---|---|---|
| Acetaldehyde (μg/puff) | 28.9 | 52.8 |
| Acetone (μg/puff) | 13.2 | 28.0 |
| Acetonitrile (μg/puff) | 3.5 | 15.0 |
| Acrolein (μg/puff) | 2.9 | 4.9 |
| Benzene (μg/puff) | 2.6 | 5.6 |
| Furan (μg/puff) | 1.3 | 1.9 |
| Isobutraldehyde (μg/puff) | 1.1 | 2.6 |
| Phenols (μg/cig.) | <5.0 | 9.8 |
| Propionaldehyde (μg/puff) | 3.1 | 4.2 |
| Carbon Monoxide (vol. %) | 1.7 | 3.6 |
| Hydrogen Cyanide (μg/cig.) | 8.0 | 216.0 |
| Benzo (α) Pyrene (μg/100 cig.) | 0.7 | 2.8 |

It will be evident from the above example that the herein defined formulations, may contain ingredients in addition to the combustible substrate, tobacco and/or combustion modifiers where desired. Such additional materials include, without limitation, ash modifiers, such as fiberglass and organic fibers; flavor and odor modifiers, such as tobacco extracts, synthetic flavors, nicotine or sugars; coloring agents, such as carbon, food dyes and inorganic pigments; plasticizers and humectants, such as butylene glycol, glycerine and propylene glycol; and wetting agents.

Smoking products may be prepared entirely from the herein described tobacco replacements or from any desired combination of the replacement with tobacco, reconstituted tobacco, or other tobacco replacements.

While the present invention has been described with specific illustrations, it is to be understood that many modifications may be made thereto without departing from the spirit and scope thereof.

What is claimed is:

1. Improved smoking composition comprising a combustible organic ingredient and a particulate inorganic filler, the major proportion of said combustible organic ingredient being a material selected from the group consisting of film-forming cellulose derivatives, their salts and mixtures thereof having the recurring anhydroglucose unit:

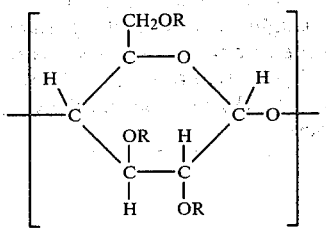

wherein at least one R is selected from the group consisting of lower alkyl, carboxyl lower alkyl, hydroxy lower alkyl groups and mixtures thereof; and the remaining Rs are hydrogen and the average degree of substitution is from about 0.2 to 3.0; said major portion of said combustible organic ingredient and said particulate inorganic filler being present in a weight to weight ratio of about 15:85 to 85:15 and from about 0.1 to 5.0 percent by weight of said smoking composition of a material selected from the group consisting of proteins and protein hydrolysates, at least 80 percent of the weight of which is derived from aliphatic and heterocyclic amino acids.

2. The smoking compositions of claim 1, wherein less than 10 percent by weight of said material is derived from sulfur-containing amino acids.

3. The smoking compositions of claim 1, wherein said material is selected from the group consisting of egg albumen, gelatine, collagen, soybean protein, casein, zein and gliadin.

4. The smoking compositions of claim 1, wherein said tobacco replacements are comprised of a combustible substrate having uniformly dispersed therein a combustion modifier, said combustible substrate and combustion modifier being present in a ratio of from about 15:85 to about 85:15.

5. The smoking compositions of claim 1 containing up to 40 percent by weight of said smoking compositions of tobacco dust uniformly dispersed therein.

6. The smoking compositions of claim 1, wherein the major portion of said combustible organic ingredient is selected from the group consisting of carboxymethyl cellulose, carboxyethyl cellulose, hydroxethyl cellulose, carboxymethyl hydroxyethyl cellulose, methyl cellulose, ethyl cellulose, the salts of said celluloses and mixtures thereof.

7. An improved cigarette, the filler of which is comprised of a smoking composition comprised of a combustible organic ingredient and a particulate inorganic filler, the major portion of said combustible organic ingredient being a material selected from the group consisting of film-forming cellulose derivatives, their salts and mixtures thereof having the recurring anhydroglucose unit:

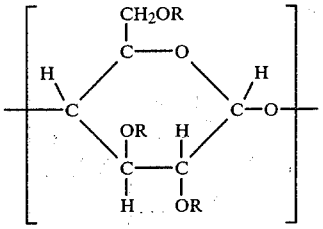

wherein at least one R is selected from the group consisting of lower alkyl, carboxyl lower alkyl, hydroxy lower alkyl groups and mixtures thereof; and the remaining Rs are hydrogen and the average degree of substitution is from about 0.2 to 3.0; said major portion of said combustible organic ingredient and said particulate inorganic filler being present in a weight to weight ratio of about 15:85 to 85:15 and from about 0.1 to 5.0 percent by weight of said smoking composition of a material selected from the group consisting of protein and protein hydrolysates, at least 80 percent of the weight of which is derived from aliphatic and heterocyclic amino acids.

8. Improved smoking composition comprising a combustible organic ingredient and a particulate inorganic filler, the major proportion of said combustible organic ingredient being a material selected from the group consisting of film-forming cellulose derivatives, their salts and mixtures thereof having the recurring anhydroglucose unit:

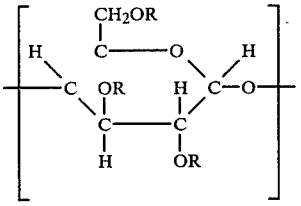

wherein at least one R is selected from the group consisting of lower alkyl, carboxyl lower alkyl, hydroxy lower alkyl groups and mixtures thereof; and the remaining R's are hydrogen and the average degree of substitution is from about 0.2 to 3.0; said major portion of said combustible organic ingredient and said particulate inorganic filler being present in a weight to weight ratio of 15:85 to 28.2:71.8 and from about 0.1 to 5.0 percent by weight of said smoking composition of a material selected from the group consisting of proteins and protein hydrolysates, at least 80 percent of the weight of which is derived from aliphatic and heterocyclic amino acids.

9. The smoking compositions of claim 8, wherein the major portion of said combustible organic ingredient is selected from the group consisting of carboxymethyl cellulose, carboxyethyl cellulose, hydroxyethyl cellulose, carboxymethyl hydroxyethyl cellulose, methyl cellulose, ethyl cellulose, the salts of said celluloses and mixtures thereof.

10. An improved cigarette, the filler of which is comprised of a smoking composition comprised of a combustible organic ingredient and a particulate inorganic filler, the major portion of said combustible organic ingredient being a material selected from the group consisting of film-forming cellulose derivatives, their salts and mixtures thereof having the recurring anhydroglucose unit:

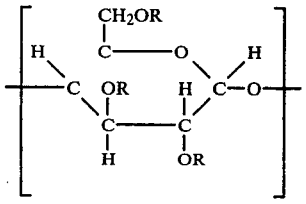

wherein at least one R is selected from the group consisting of lower alkyl, carboxyl lower alkyl, hydroxy lower alkyl groups and mixtures thereof; and the remaining R's are hydrogen and the average degree of substitution is from about 0.2 to 3.0; said major portion of said combustible organic ingredient and said particulate inorganic filler being present in a weight to weight ratio of 15:85 to 28.2:71.8 and from about 0.1 to 5.0 percent by weight of said smoking composition of a material selected from the group consisting of protein and protein hydrolysates, at least 80 percent of the weight of which is derived from aliphatic and heterocyclic amino acids.

* * * * *